US011129458B2

(12) United States Patent
Litson

(10) Patent No.: US 11,129,458 B2
(45) Date of Patent: Sep. 28, 2021

(54) HAIR CURLER

(71) Applicant: Caitlyn Litson, Washington, UT (US)

(72) Inventor: Caitlyn Litson, Washington, UT (US)

(73) Assignee: La Courant, LLC, Washington, UT (US)

( * ) Notice: Subject to any disclaimer, the term of this patent is extended or adjusted under 35 U.S.C. 154(b) by 150 days.

(21) Appl. No.: 16/298,786

(22) Filed: Mar. 11, 2019

(65) Prior Publication Data

US 2019/0274406 A1 Sep. 12, 2019

Related U.S. Application Data

(60) Provisional application No. 62/641,292, filed on Mar. 10, 2018.

(51) Int. Cl.

| | |
|---|---|
| ***A45D 2/12*** | (2006.01) |
| ***A45D 2/14*** | (2006.01) |
| ***A45D 7/00*** | (2006.01) |

(52) U.S. Cl.

CPC ..... *A45D 2/125* (2013.01); *A45D 2/146* (2013.01); *A45D 7/00* (2013.01)

(58) Field of Classification Search

CPC ..... A45D 2/125; A45D 2/127; A45D 2/122; A45D 2/2492; A45D 2/00; A45D 2/18; A45D 2/20; A45D 2002/003; A45D 2002/005; A45D 2002/006; A45D 2002/007; A45D 2002/008; A45D 8/004; A45D 8/28; A45D 8/38; A45D 8/40

See application file for complete search history.

(56) References Cited

U.S. PATENT DOCUMENTS

| | | | | | |
|---|---|---|---|---|---|
| 944,226 | A * | 12/1909 | West | | |
| 2,663,302 | A * | 12/1953 | Palitti | A45D 2/2492 | 132/246 |
| 4,310,008 | A * | 1/1982 | Lalli | A45D 2/14 | 132/247 |
| 2003/0136421 | A1* | 7/2003 | Trent | A45D 2/122 | 132/258 |
| 2013/0269723 | A1* | 10/2013 | Hu | A45D 2/127 | 132/248 |

FOREIGN PATENT DOCUMENTS

FR 1317991 * 2/1963

OTHER PUBLICATIONS

Machine translation of Dentelles Du Velay (Year: 1963).*

* cited by examiner

*Primary Examiner* — Rachel R Steitz
*Assistant Examiner* — Brianne E Kalach
(74) *Attorney, Agent, or Firm* — Gurr Brande & Spendlove, PLLC; Robert A. Gurr

(57) ABSTRACT

A hair curler has a cylindrical body with a net attached to a first end of the cylindrical body, the net invertable to permit extension of the net around the cylindrical body, holding hair in place that is wrapped around the cylindrical body. Because no hard plastics or other hard or rigid materials are present, the hair curler is comfortable for a user while sleeping or lying.

3 Claims, 7 Drawing Sheets

HAIR CURLER

CROSS-REFERENCE TO RELATED APPLICATIONS

This application claims the benefit of U.S. Provisional Application Ser. No. 62/641,292, filed on Mar. 10, 2018, which is incorporated herein by reference.

TECHNICAL FIELD

The present disclosure relates to hair curlers. More particularly, the present disclosure relates to foam hair curlers that may be used for overnight styling of hair without discomfort and without the need for heat application or chemical treatment to properly style the hair.

BACKGROUND

Trends in fashions for hair styling have far outpaced the ability of product technology to adapt readily to these new trends, to make these newer styles easy and comfortable to apply, and to use. Individuals have long sought to style their hair by modifying the waviness or curliness of the hair. Processes to allow such curling of the hair often use the application of thermal heat or chemical products to change, reset, or adjust the bonds of protein structures within the strands of hair and thereby be able to fixate the hair in different patterns, such as straight, wavy, or curly. Such thermal heating processes and chemical processes present a real risk of possibly long-lasting or permanent damage to the physical structure of the hair. As such, stylists look for other technological means to style hair without the need or risk of thermal heat application or use of harsh chemicals.

One way adopted by stylists to enable them to style hair in waves or curls without substantial use of heat or chemical processes, is for stylists (or consumers) to style and set hair via mechanical means; for example, to fix portions of the hair for a length of time wrapped about hard plastic curlers (or rollers). A disadvantage of such mechanical methods to create waves or curls in the hair is that these methods often take a much longer duration to set the hair than methods which use heat and/or chemicals. As such, these mechanical curling processes, which frequently involve overnight application of hard plastic curlers, can create inconvenience and discomfort for the user. Other mechanical curling processes make use of hook-and-loop fastener (e.g., Velcro®) curlers to secure the hair portions in the desired position for a length of time. These hook-and-loop fastener curlers can also cause significant inconvenience and discomfort for users, especially in that strands of hair can easily become entangled within or between the hook-and-loop fasteners and cause discomfort, making the act of removing the curler and releasing the user's hair difficult and potentially painful, with attendant risks of pulling, including pulling out (removing), portions of the user's hair. Other mechanical curling processes include the use of securing pieces, such as clips, pins, or bands, to hold the hair portions fixed in the desired position. Unfortunately, these securing pieces may also cause discomfort or inconvenience and often can lead to unwanted lines or indentations in the styled hair.

Accordingly, there is a need for tools that allow stylists and consumers to style hair, for example, by adding waves or curls, without creating risks to the health of the hair and without creating unnecessary expense, discomfort, or inconvenience for the user. The present disclosure seeks to solve these and other problems.

SUMMARY OF EXAMPLE EMBODIMENTS

In one embodiment, a hair curler comprises a soft foam cylindrical body having an elasticized fabric net attached at one end of the curler body. Portions of the user's hair to be styled may be wrapped or curled about the cylindrical body and then the elasticized fabric net may be inverted about the hair portion and the cylindrical body to maintain the hair portion in a curled position for a sufficient period of time, including possibly an overnight period, to allow the hair portion to maintain the curled form upon release or removal from the curler, all without causing, or by minimizing, discomfort to the user throughout the process.

BRIEF DESCRIPTION OF THE DRAWINGS

Some embodiments of the present invention are illustrated as an example and are not limited by the figures of the accompanying drawings. The figures are illustrative of invention functionality and are not necessarily to actual scale.

DETAILED DESCRIPTION OF EXAMPLE EMBODIMENTS

Figure 1:
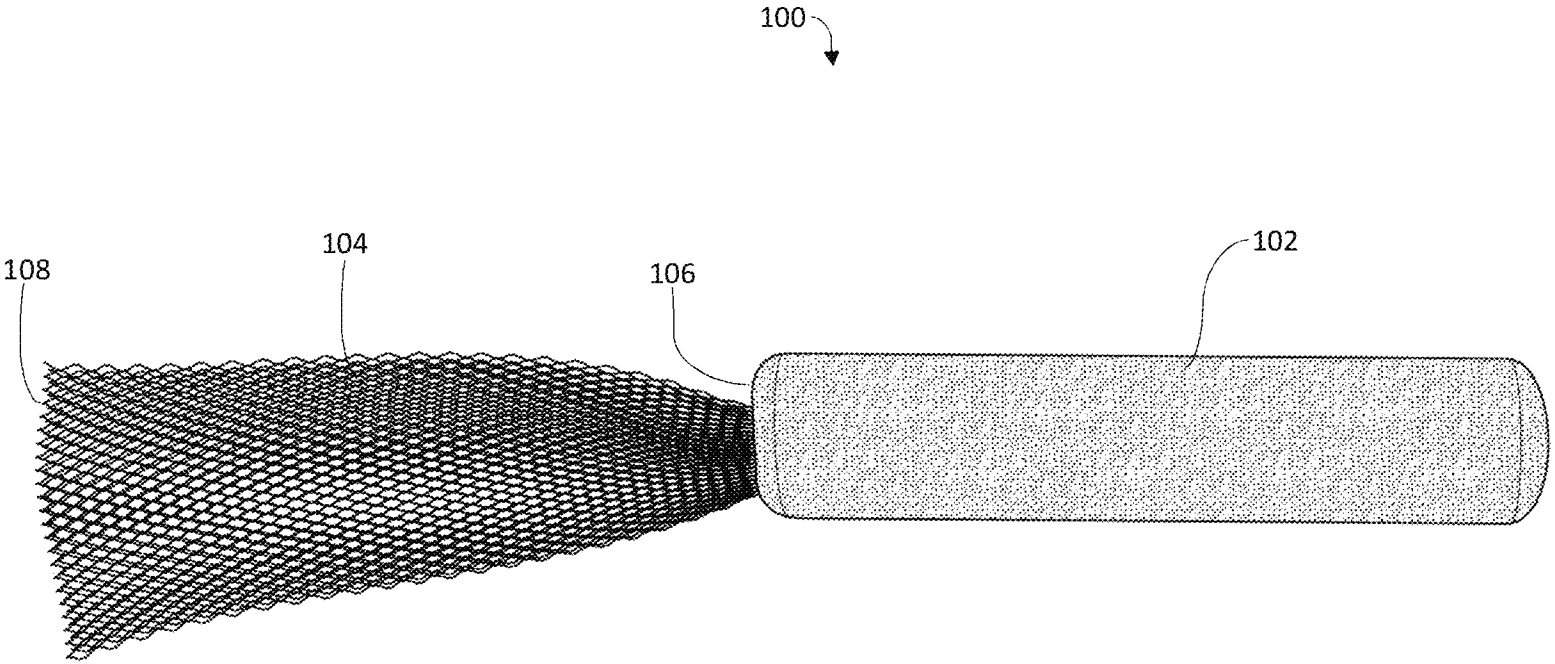
FIG. 1 illustrates a side elevation view of the hair curler with the net extending from a first end of the cylindrical body.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof.

Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for tools that allow stylists and consumers to style hair, for example, by adding waves or curls, without creating risks to the health of the hair and without creating unnecessary expense, discomfort, or inconvenience for the user. The present invention allows users to curl and style hair comfortably and conveniently while minimizing risk and cost.

In one embodiment, as depicted in FIGS. 1-4, a hair curler 100 comprises a cylindrical body 102 and a net 104 coupled to a first end 106 of the cylindrical body 102. The cylindrical body 102 is ideally comprised of foam material sufficiently soft, and providing sufficient cushion, to allow the curler 100 to be worn by a consumer overnight, yet resilient enough in strength to allow the cylindrical body 102 to substantially maintain, or substantially revert to, its initial shape or form without deformation, degradation, or destruction (e.g., breaking, crumbling or flaking, of the cylindrical body). This allows the hair curler 100 to be reused multiple times by a user. In other embodiments, the cylindrical body 102 may be comprised of other materials that are sufficiently soft to allow comfortable overnight use yet also sufficiently resilient to substantially maintain or revert to its initial shape over multiple applications, including such materials as polyvinyl chloride (foam rubber). In preferred embodiments, the cylindrical body 102 will be of sufficiently durable material, such as resilient foam materials, to prevent or minimize degradation of the material due to water exposure or water immersion.

Figure 2:
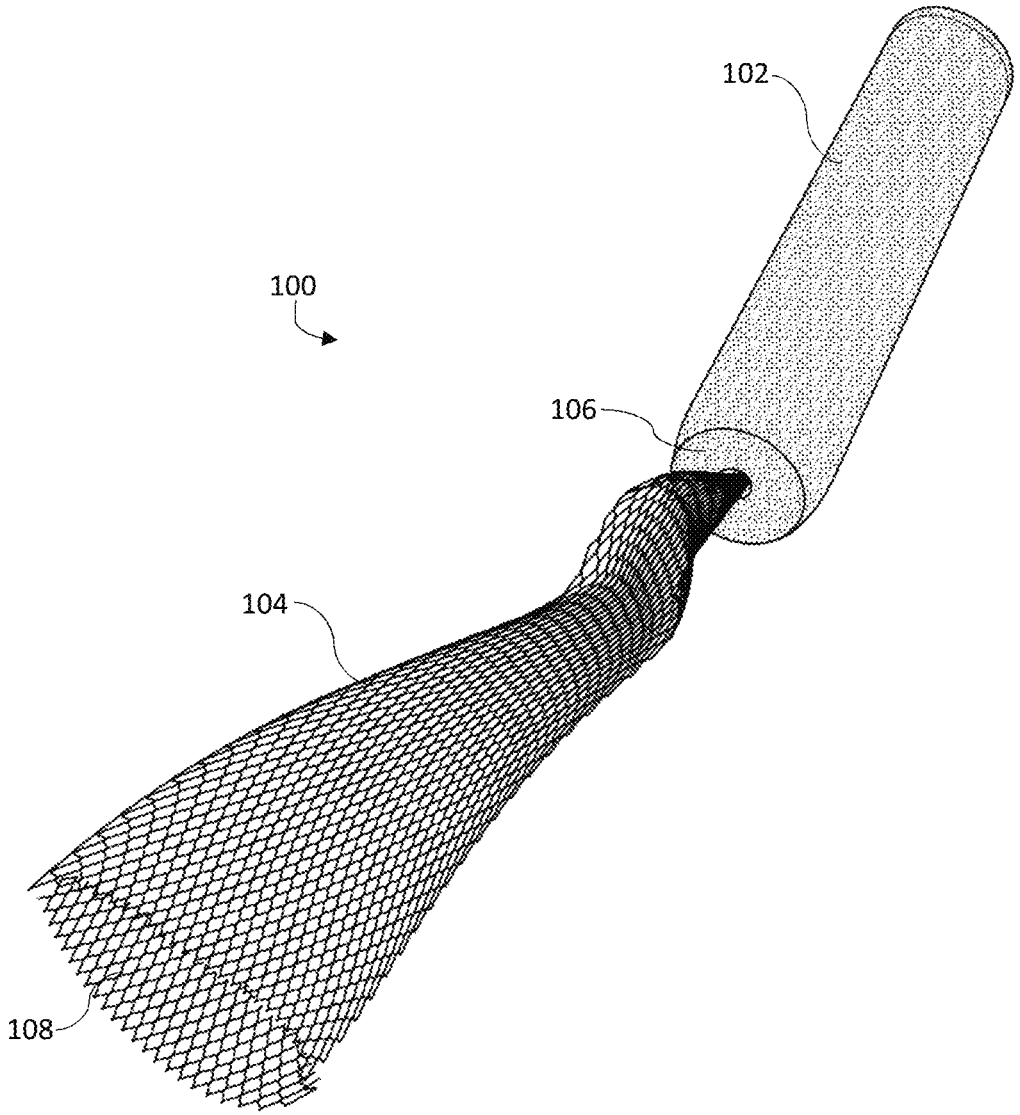
FIG. 2 is a front perspective view of the hair curler with the net extending from a first end of the cylindrical body.

In one embodiment, as best seen in FIGS. 1-2, the net 104 may be substantially conical in shape. However, the invention should not be limited to a conical-shaped net 104, as other shapes may be used (cylindrical). In one embodiment, the open-end 108 of the net 104 may further comprise elastics or other materials to aid in securing the net to the cylindrical body 102 when inverted (i.e., turned inside out to surround the body 102, also referred to as "invertable"). In one embodiment, the net 104 is coupled to the cylindrical body 102 by a substantially chemical process; for example, a variety of adhesives known in the art (e.g., fabric glue, hot glue, etc.), may be used to couple the net 104 to the cylindrical body 102. In another embodiment, the net 104 is secured by mechanical process, such as by stitching, tying, crimping, or stapling the net 104 to the first end 106 of the cylindrical body 102. In yet another embodiment, some combination of chemical and mechanical processes may be used. In yet another embodiment, the net 104 is removably attachable to the body 102 (e.g., hook and loop, snap, etc.). In another embodiment, the net 104 is not attachable to the body 102, but rather is a separate component that may fully-encompass the body 102. As an example, the net 104 may be placed over the body 102 during storage. A user would then completely remove the net 102 from the body 102 to wrap hair around the body 102. Once hair is wrapped around the body 102, the user could wrap the net over the body 102 and curled hair, thereby securing the hair to the body 102. Elastics may be used on or more ends of the net 104 to hold it in place on, or around, the body 102.

In one embodiment, the net 104 is comprised of a synthetic polymer, such as nylon. In other embodiments, all or portions of the net 104 may be comprised of such materials as silk, cotton, polyester, natural or synthetic polymers, blends (e.g., spandex-nylon), or other suitable materials. In one embodiment, the net 104 comprises elastic properties, such that when inverted to surround the curler body 102, the net 104 is secured to the body 102 due to the elasticity.

Figure 3:
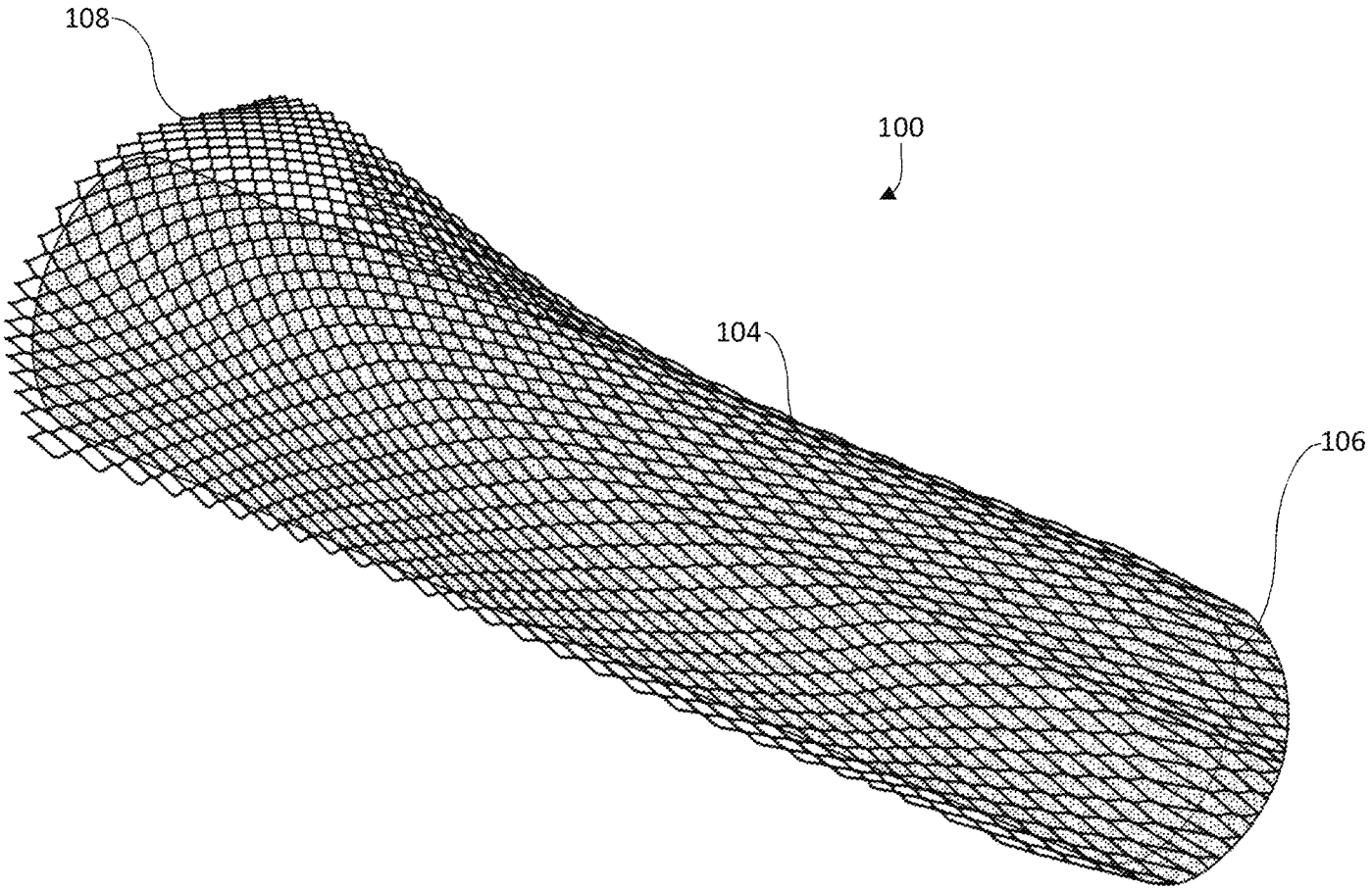
FIG. 3 is a side perspective view of the hair curler with the net inverted and surrounding the cylindrical body.
Figure 4:
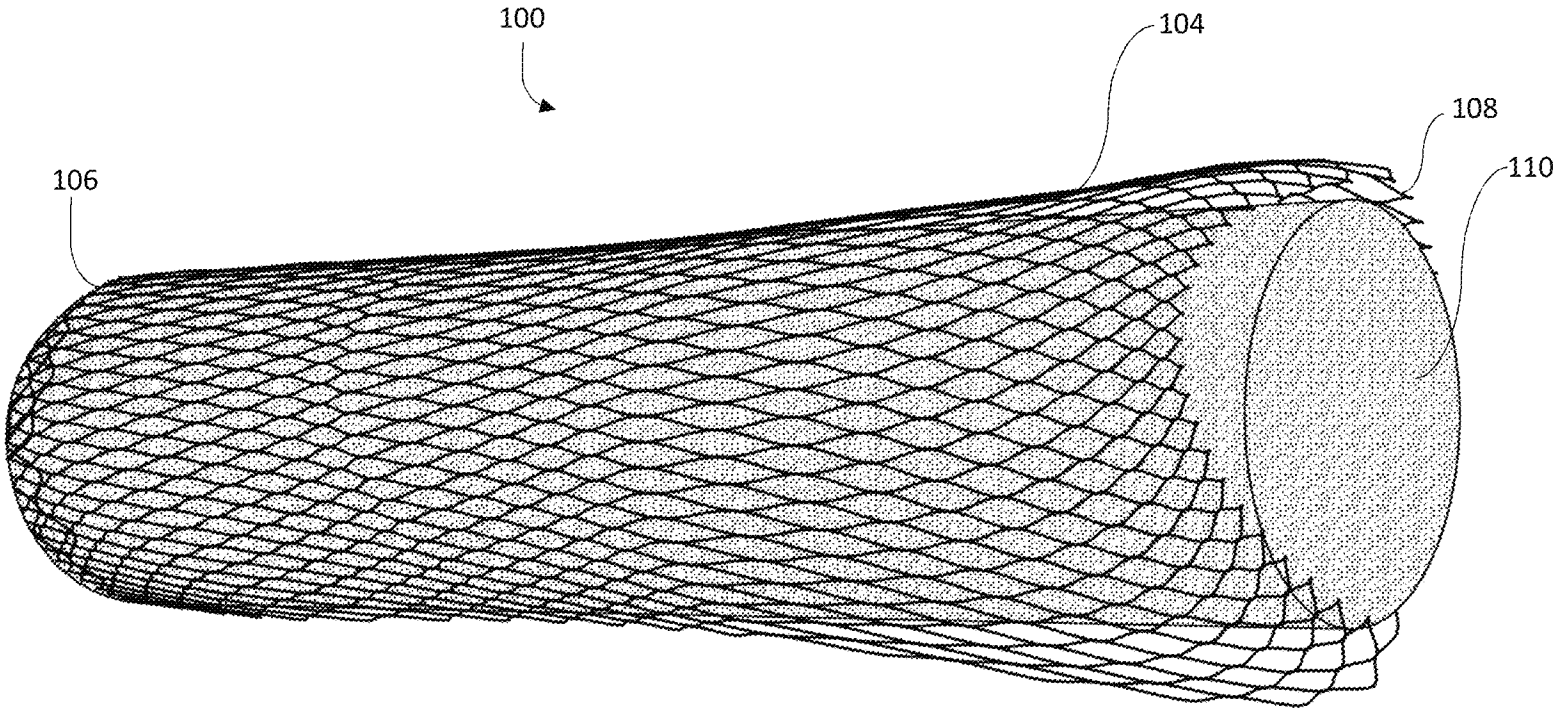
FIG. 4 is a rear perspective view of the hair curler with the net inverted and surrounding the cylindrical body.

FIGS. 3-4 illustrate the net 104 surrounding the cylindrical body 102. This is accomplished by inverting the net 104 and pulling it over the cylindrical body 102. As shown in FIG. 4, the net 104 extends the length of the body 102 to its second end 110. In one embodiment, the net 104 may also extend so as to cover the second end 110, and may, or may not, comprise a means to further secure the net in position. For example, a securing means may be an elastic material, pin, snap, hook and loop, or other material where the open end 108 of the net 104 meets the second end 110 of the body 102.

Figure 5:
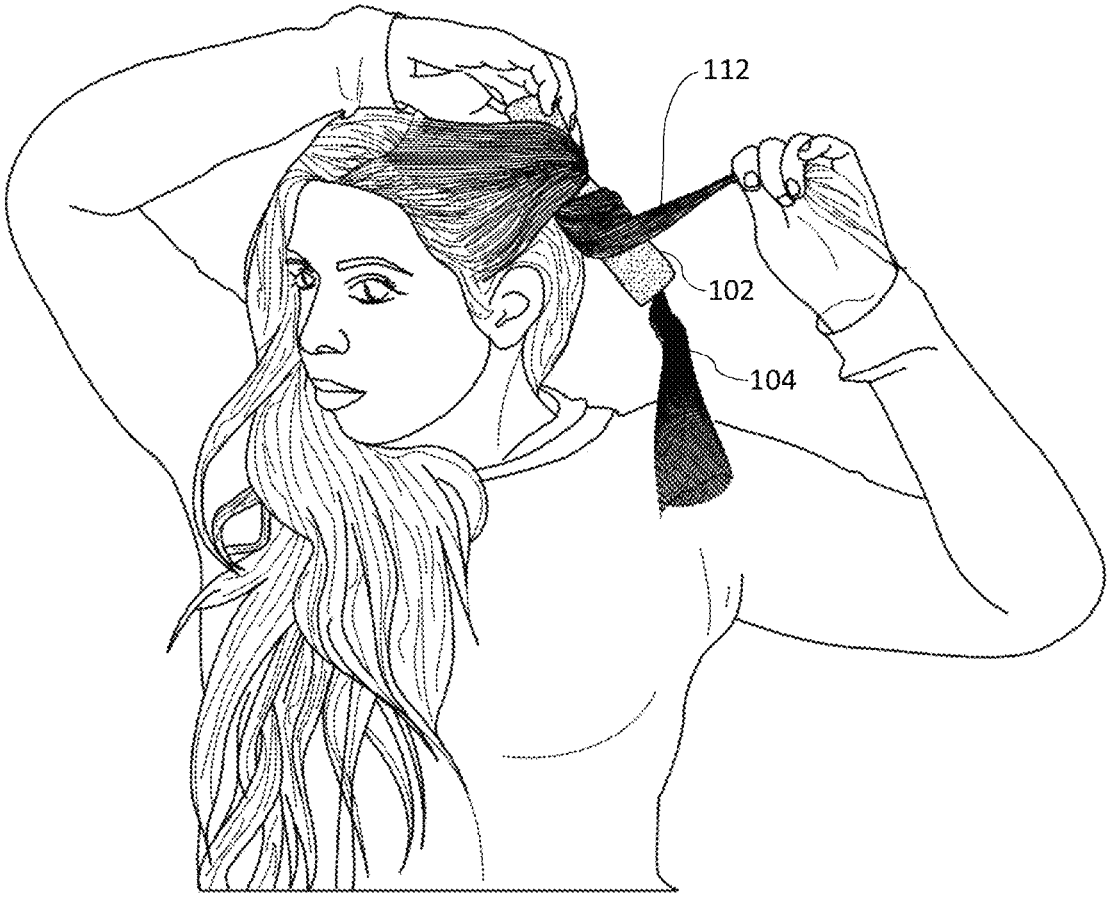
FIG. 5 illustrates a user wrapping hair around the cylindrical body, the next extending outwardly from the first end.
Figure 6:
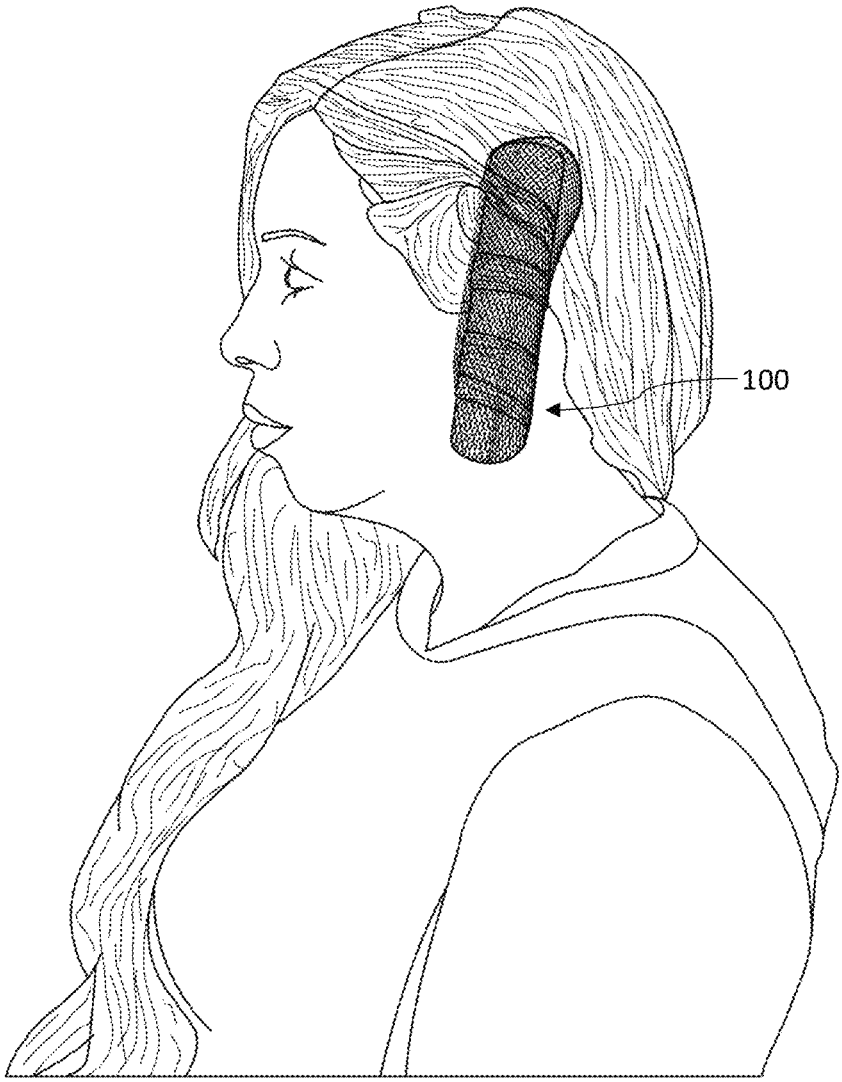
FIG. 6 illustrates the hair curler in use, the hair wrapped around the cylindrical body, the net inverted and surrounding the hair and cylindrical body.

In one embodiment, as shown in FIG. 5, a user may wrap strands of hair 112 around the cylindrical body 102 to position the hair 112 in a substantially helical shape so as to form a wave or a curl. Once the hair 112 is properly positioned around the cylindrical body 102, the user (or an assistant) may invert and wrap the net 104 over, and thus encompass or sheath, the hair 112 and cylindrical body 102, as shown in FIG. 6. The hair 112 may then be maintained in a curled position around the cylindrical body 102 for the desired duration. One of the benefits of using constructing the body 102 from foam and using an adhesive for the net 104 is that no rigid, hard, or uncomfortable components are present. In other words, a user may comfortably sleep with one or more curlers 100 in their hair without being uncomfortable. This overcomes problems in the prior art. For example, curlers in the art use hard plastics, hooks and loops, and other materials that are typically unpleasant to sleep on and to remove hair from. Accordingly, the curler 100 overcomes those problems and limitations by using a foam body 102 with a net 104 to secure the hair.

Figure 7:
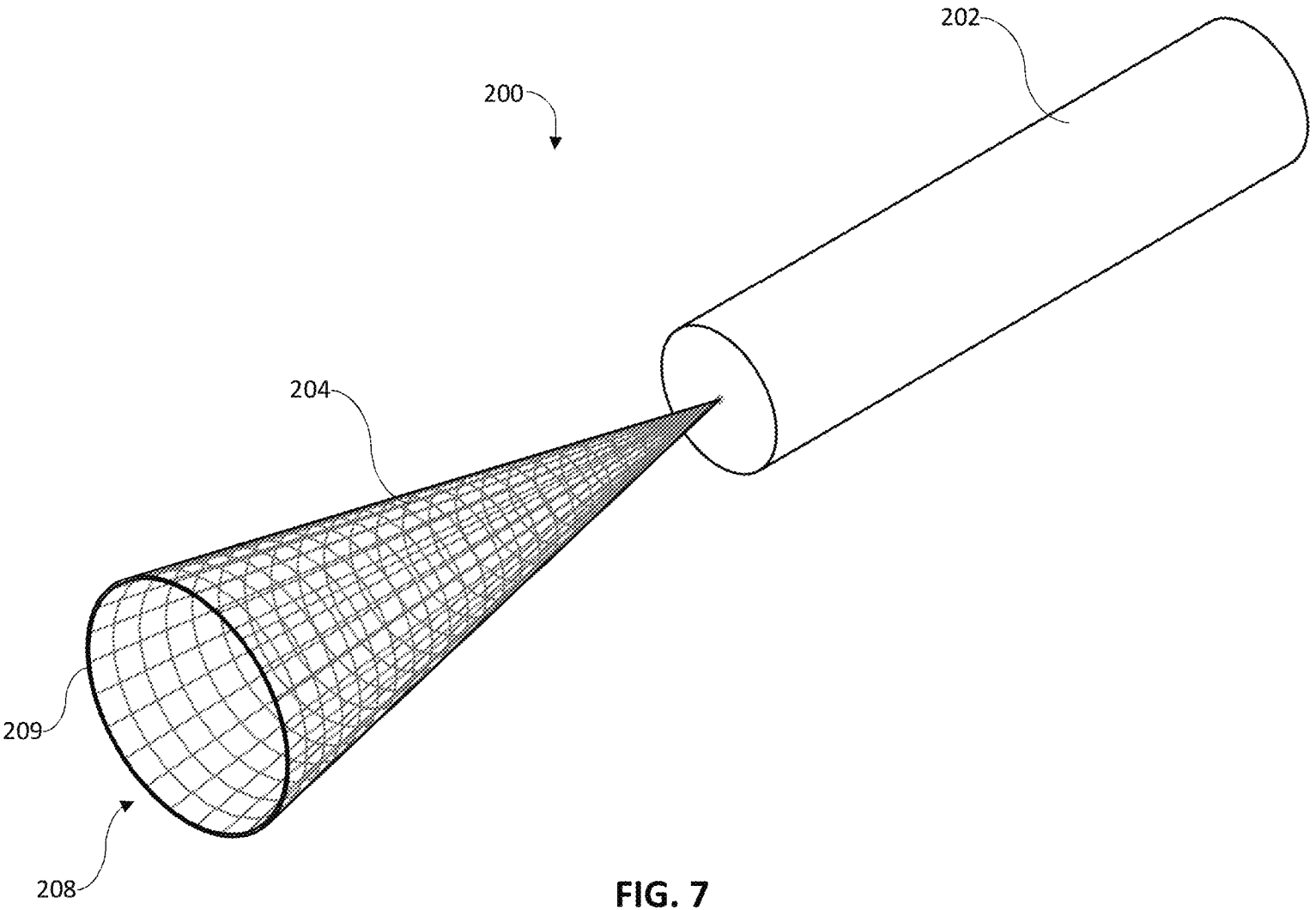
FIG. 7 illustrates a front end, perspective view of a hair curler, the next extending outwardly from the first end.

FIG. 7 illustrates a hair curler 200 comprising an elastic band 209 that terminates the open-end 208 of the net 204. The elastic band 209 aids in securing the net 204 to the cylindrical body 202 when inverted. As such, the elastic band 209 keeps the net 204, and therefore the hair, secured around the curler body 202.

It will be appreciated that the cylindrical body 102 may vary in size, according to the desires of the user. For example, the body 102 may be in a range from three to eight inches in length. For example, shorter lengths would be used for short hairstyles, while longer lengths are used for longer hairstyles. While sizes are given as examples herein, they are not to be considered limiting, and sizes differing from those mentioned here are contemplated. In one embodiment, the cylindrical body 102 may be in a range from one-half inch in diameter to four inches in diameter. In one embodiment, the net 104 is proportionate in size relative to the cylindrical body 102. For example, if the body 102 is eight inches in length, the net 104 will be of sufficient size and elasticity to extend and encompass at least to the second end 110 of the body 102.

Therefore, it will be appreciated that the hair curler 100 solves the need for a curler that is inexpensive, easy to use, does not require heat or chemical treatment, that is comfortable to lay on while sleeping, and that is easy to remove.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A hair curler for styling hair, the hair curler comprising:

a cylindrical body; and a net;

the net consisting of elastic material and forming an envelope that extends between a first end and a free end, the first end adhesively attaching to a center of a first face of the cylindrical body, and the free end forming an open end, such that the net creates a conical envelope with the open end remote from the cylindrical body in an unstretched condition;

the conical envelope of the net configured to be stretched and inverted over the cylindrical body such that the free end extends toward a second end of the cylindrical body.

2. The hair curler of claim 1, wherein the cylindrical body comprises foam.

3. A method of curling hair comprising:

using a hair curler to style hair, the hair curler comprising:

a cylindrical body comprising foam; and a net;

the net consisting of elastic material and forming an envelope that extends between a first end and a free end, the first end adhesively attaching to a center of a first face of the cylindrical body, and the free end forming an open end, such that the net creates a conical envelope with the open end remote from the cylindrical body in an unstretched condition;

the conical envelope of the net configured to be stretched and inverted over the cylindrical body such that the free end extends toward a second end of the cylindrical body, and the open end terminating with an elastic band;

wrapping hair around the cylindrical body of the hair curler to position the hair in a substantially helical shape;

placing the net around the cylindrical body, the net extending from the first end to the second end of the cylindrical body and encompassing the hair, the elastic band maintaining the placement of the net and hair around the cylindrical body; and leaving the hair curler in the hair for a desired time.

* * * * *